United States Patent [19]

Watanabe

[11] Patent Number: 4,506,766

[45] Date of Patent: Mar. 26, 1985

[54] METHOD AND APPARATUS FOR FAULT TIME OPERATING OF AN ELEVATOR

[75] Inventor: Eiki Watanabe, Inazawa, Japan

[73] Assignee: Mitsubishi Denki Kabushiki Kaisha, Tokyo, Japan

[21] Appl. No.: 627,700

[22] Filed: Jul. 3, 1984

[30] Foreign Application Priority Data

Aug. 17, 1983 [JP] Japan ..... 58-149922

[51] Int. Cl.[3] ..... B66B 5/02

[52] U.S. Cl. ..... 187/29 R; 187/29 R; 307/64; 307/66; 363/37; 318/801; 318/802

[58] Field of Search ..... 187/29, 29 R; 318/333, 318/345 B, 345 C, 345 F, 800, 801, 802, 803; 363/37, 34, 50, 65; 307/64, 66; 361/23, 31, 87, 98, 100

[56] References Cited

U.S. PATENT DOCUMENTS

| | | | |
|---|---|---|---|
| 3,614,461 | 10/1971 | Speer | 307/66 X |
| 3,986,098 | 10/1976 | Tamii et al. | 307/66 X |
| 4,122,516 | 10/1978 | Tokunaga | 307/64 X |
| 4,284,175 | 8/1981 | Ishii et al. | 187/29 R |
| 4,316,097 | 2/1982 | Reynolds | 307/66 |
| 4,331,994 | 5/1982 | Wirth | 361/100 X |
| 4,376,471 | 3/1983 | Uchino et al. | 307/64 X |
| 4,399,892 | 8/1983 | Watanabe | 187/29 R |
| 4,454,930 | 6/1984 | Nomura et al. | 307/64 X |
| 4,471,855 | 9/1984 | Masami et al. | 318/803 X |

FOREIGN PATENT DOCUMENTS

| | | | |
|---|---|---|---|
| 2105128 | 3/1983 | United Kingdom | 307/64 |

*Primary Examiner*—Willim M. Shoop
*Assistant Examiner*—Paul Shik Luen Ip
*Attorney, Agent, or Firm*—Sughrue, Mion, Zinn, Macpeak and Seas

[57] ABSTRACT

An elevator drive motor 1 is normally energized from an AC power source 8 via an AC-DC converter 4 and a DC-AC inverter 3. When the power source fails the elevator is braked and the inverter is supplied from an emergency battery 11 to access the nearest floor for passenger discharge. If a fault occurs in the inverter it is disconnected from the motor by opening a switch contact 15*a*, and the closing of a further contact 15*b* enables the converter to energize the motor in a "reverse function" mode from the battery.

9 Claims, 3 Drawing Figures

METHOD AND APPARATUS FOR FAULT TIME OPERATING OF AN ELEVATOR

BACKGROUND OF THE INVENTION

This invention relates to a method and apparatus for the fault time operation of an elevator or lift which is provided with a symmetrically arranged variable voltage, variable frequency (VVVF) electric power converting apparatus.

The fault time operation of an elevator utilizing a conventional symmetrically arranged VVVF power converting apparatus will be described with reference to FIG. 1, wherein the power of an induction motor 1 driving the elevator is supplied from an inverter 3 through an AC reactor 2. A tachometer generator 1*a* is coupled with the induction motor 1 for applying a voltage corresponding to the running speed of the motor to a control device 12 operable as a microcomputer and comprising a CPU 12*a*, a RAM 12*b*, a ROM 12*c* and an interface 12*d*. The control device 12 digitally controls switching signals applied to the bases of the transistors included in a converter 4 and the inverter 3. Since the operation of the microcomputer is well known in the art, a detailed description thereof is omitted.

The converter 4 is connected to a three-phase AC power source 8 through a contact 7*a* of a relay (not shown) and an AC reactor 6. A current transformer CT is connected to the converter input and its output is applied to the control device 12. The converter 4 converts AC power received from the source 8 into DC power, which is smoothed by a capacitor 5 and supplied to the inverter 3. The inverter converts the DC power back into AC power which is supplied through the reactor 2 to the induction motor as described above.

The three-phase AC voltage from the power source 8 is applied through a transformer 9 to a battery charger 10 including a diode bridge or the like which converts the AC voltage into a DC voltage for charging a battery 11. A serially connected circuit of the battery 11 and a contact 7*b* of the relay is connected in parallel with the capacitor 5, between input terminals A and B of the inverter 3. The AC voltage of the source 8 is also applied through another transformer 13 to the control device 12, which controls the conductance of component elements of the converter 4 and inverter 3 based on the output of the tachometer generator 1*a* and a command signal voltage Vp.

The relay contact 7*a* is spring biased open when its relay is deenergized, and vice versa for contact 7*b*.

The inverter 3 includes transistors and diodes that are connected with the transistors in parallel opposition. Under the control of the device 12, the inverter 3 is operated in a variable voltage, variable frequency mode by pulse width modulation. Since such operation is widely known, further description thereof is omitted.

The converter 4 also includes transistors and parallel opposition diodes. In the normal operation of the elevator wherein the relay contact 7*a* is closed and contact 7*b* is open, the induction motor 1 is energized from the three-phase AC power source 8 through contact 7*a*, reactor 6, the diodes in the converter 4, the transistors in the inverter 3, and the reactor 2.

In the regenerating mode, electric power is regenerated from the induction motor through the reactor 2, the inverter diodes, the converter transistors, reactor 6 and contact 7*a* to the power source 8.

The inverter 3 and the converter 4 are symmetrically constructed; their combination is termed a symmetrical VVVF apparatus.

A failure in the AC power source 8 is detected by the control device 12 from the output of the current transformer CT, in response to which the control device opens contact 7*a* and closes contact 7*b* to connect the charged battery 11 across terminals A and B. Inverter 3 then converts the DC battery power into AC power which is applied to the induction motor through reactor 2, so that the operation of the motor and elevator may continue. Although not indicated in the drawing, the control device 12 is also provided with an emergency power source similar to the battery 11.

In the conventional symmetrical VVVF apparatus as shown in FIG. 1, when the converter 4, inverter 3 and capacitor 5 subsystem becomes faulty for some reason so as to cause any one of the following phenomena:

(1) an abnormally large current flow through the transformer CT, (2) the output of the tachometer generator 1*a* exceeding a predetermined value, or (3) the difference between the command voltage Vp applied to the control device 12 and the output voltage of the tachometer generator becoming excessive (excessive acceleration), the contact 7*a* is opened to interrupt the base currents of the transistors included in the inverter 3 and the converter 4, and a mechanical brake (not shown) is actuated to halt the movement of the elevator. To rescue persons from the stranded elevator to a nearby floor, contact 7*b* is closed a predetermined time after the brake actuation so that the converter 3 under application of the battery voltage is VVVF controlled to drive the induction motor as desired.

According to the above described emergency operation, however, if the malfunctioning component is the inverter 3, the induction motor cannot be operated by the inverter in a fault mode and the elevator passengers remain trapped at the braked position of the cage.

SUMMARY OF THE INVENTION

This invention overcomes the above described drawback by monitoring the input current of the inverter, and in response to the detection of a fault in the latter component, disconnecting the inverter output from the motor and simultaneously connecting the converter input to the motor. The converter is then operated in a reverse function mode by the control device as a DC to AC inverter, to thereby energize the motor with AC power derived from the charged emergency battery.

DETAILED DESCRIPTION OF THE PREFERRED EMBODIMENT

Figure 1:
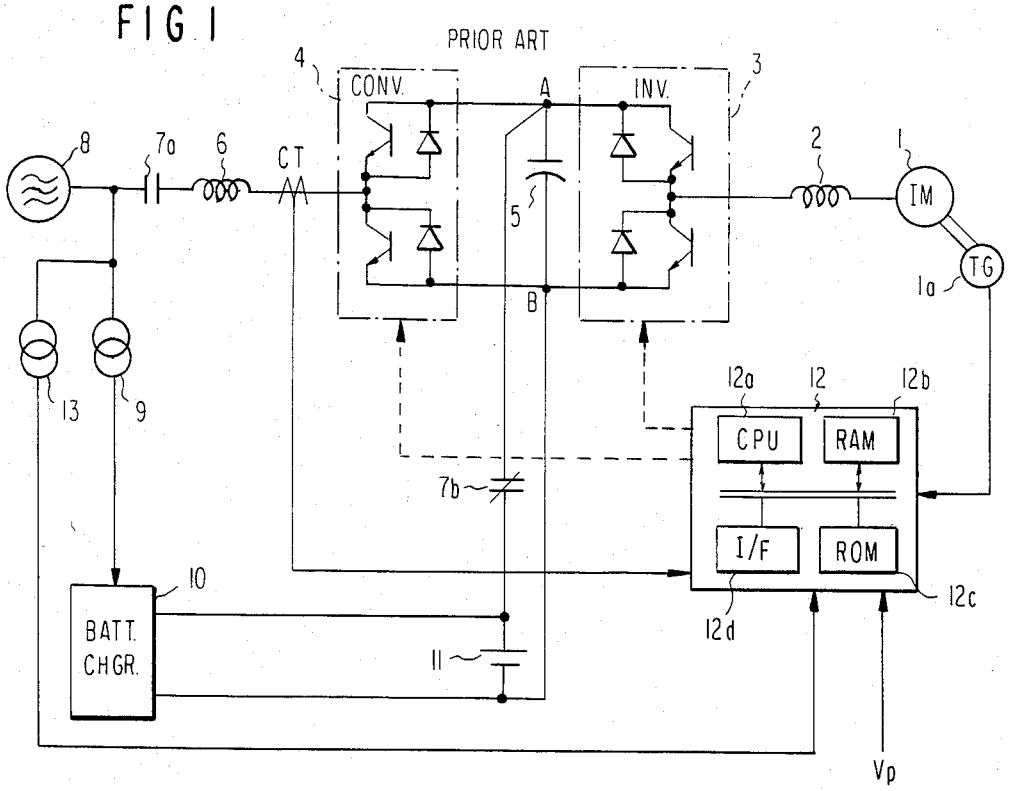
FIG. 1 is a block diagram showing a conventional fault time operating device for an elevator.
Figure 2:
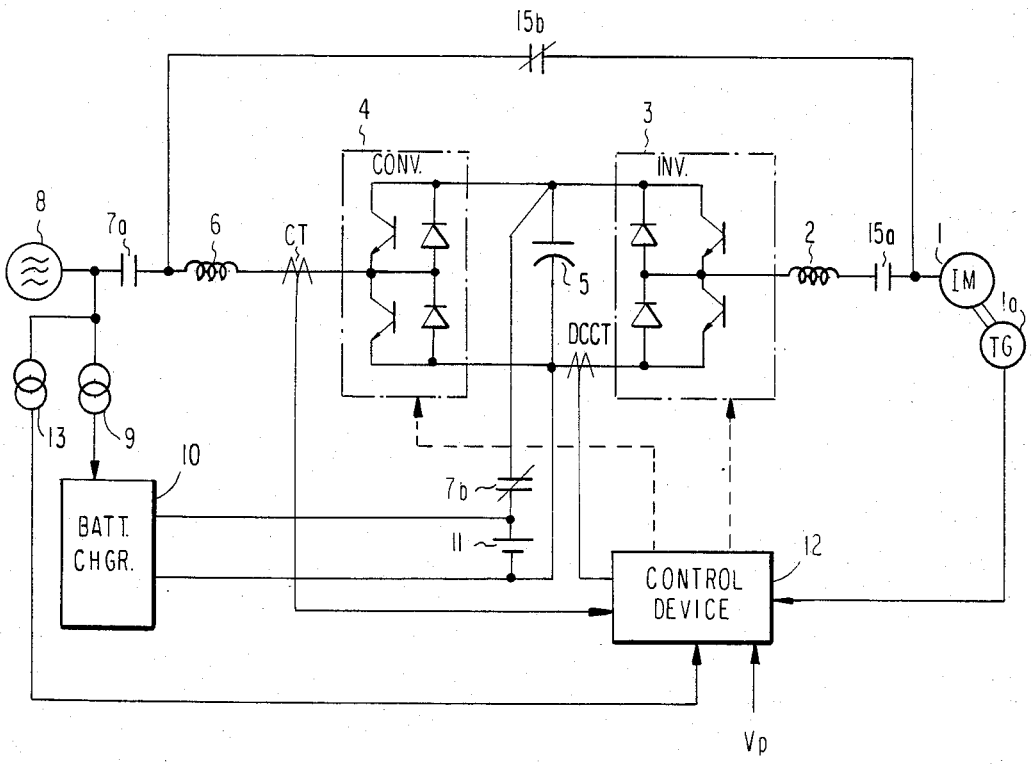
FIG. 2 is a block diagram showing a fault time operating device for an elevator according to the present invention.

Referring to FIG. 2 wherein similar members to those in FIG. 1 are designated by like reference numerals, an open biased contact 15*a* and a closed biased contact 15*b* of a relay (not shown), and a DC current detecting device DCCT are further provided in addition to the conventional circuitry shown in FIG. 1. The contact 15*a* is connected between the AC reactor 2 and the induction motor 1. One terminal of the contact 15*b* is connected between contact 7*a* and the AC reactor 6, while the other terminal thereof is connected between the contact 15*a* and the induction motor. The DC current detector DCCT is provided on the input side of the inverter 3 for detecting the occurrence of any fault in the inverter, and its output is applied to the control device 12.

With the above described construction, if a short-circuit occurs in the inverter transistors, for example, a heavy current flows into the inverter. When the DC current detector DCCT detects such current, the appropriate contactors or relays (not shown) are deenergized to open contacts 7*a* and 15*a*, and close contacts 7*b* and 15*b*. As a consequence DC power is supplied from the battery 11 to the converter 4 through contact 7*b* to drive the induction motor by the output of the converter, which is applied to the motor through reactor 6 and the closed contact 15*b*.

Figure 3:
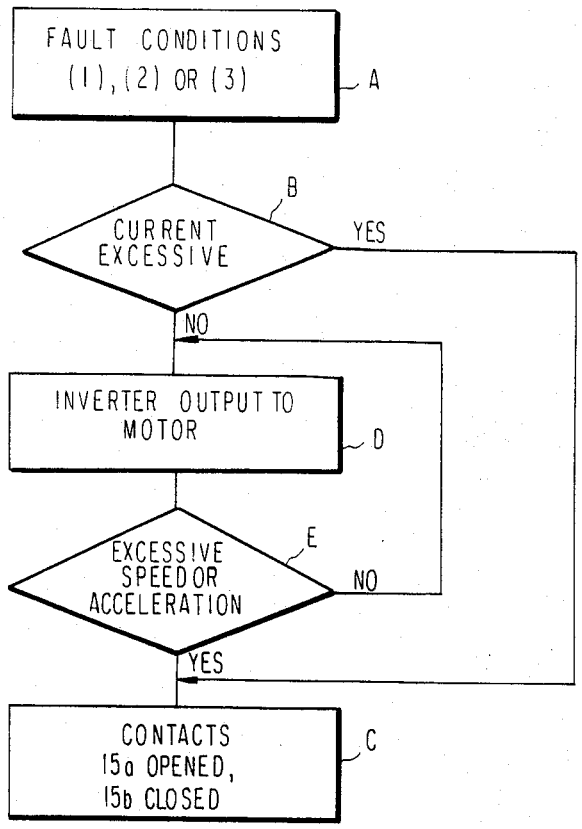
FIG. 3 is a flow chart for explaining the operation of the fault time device of the invention.

FIG. 3 is a flow chart showing the operation of the invention. When any one of the fault conditions (1) to (3) described hereinbefore occurs in step A, and when in step B it is judged that the DC current detector DCCT detects an excessive current flowing into the inverter 3, the operation is shifted from step B to step C in which contacts 15*a* and 15*b* are respectively opened and closed to operate the induction motor 1 from the output of the converter 4. Conversely, when it is judged in step B that no excessive current is flowing into the inverter, the operation proceeds to step D wherein the induction motor is operated from the output of the inverter. It is of course possible that the inverter becomes faulty regardless of no excessive current flowing into the inverter. In that case, the occurrence of fault conditions (2) and (3) is considered, and the elevator is braked according to the emergency stop procedure. The control device 12 memorizes the decision procedure, and opens contact 15*a* while closing contact 15*b* to operate the induction motor from the converter output. More specifically, the operation is shifted from step D to step E; when it is judged that faults (2) and (3) have not occurred, the operation is returned to the step D, whereas when it is judged that any one of faults (2) and (3) has occurred the operation is shifted on to step C wherein the induction motor is operated by the converter output.

In the case where only the output of the current transformer CT becomes abnormal (NO output at step E), the induction motor is operated by the battery through the inverter 3 as in the conventional device described above.

What is claimed is:

1. A fault time operation device for an elevator motor (1) driven from an AC power source (8), said device comprising:
   - (a) first means (4) for converting AC power from the source into DC power, said first means also being operable in a reverse mode to convert DC power into AC power,
   - (b) second means (3) for converting DC power from the first converting means into AC power for the motor,
   - (c) an emergency battery (11),
   - (d) first switch means (7*a*) connected between an output of the power source and an input of the first converting means,
   - (e) second switch means (7*b*) connected between the battery and a junction between an output of the first converting means and an input of the second converting means,
   - (f) third switch means (15*a*) connected between an output of the second converting means and an input of the motor,
   - (g) fourth switch means (15*b*) connected between the input of the first converting means and the input of the motor,
   - (h) first means (CT) connected to the power source output for detecting a failure thereof,
   - (i) second means (DCCT) connected to said junction for detecting a failure of the second converting means, and
   - (j) control means (12) responsive to the first and second detecting means for:
     - (1) opening the first and fourth switch means and closing the second and third switch means in resonse to a power source failure detection to energize the motor from the battery through the second converting means, and
     - (3) opening the first and third switch means and closing the second and fourth switch means in response to a second converting means failure detection to energize the motor from the battery through the first converting means operating in a reverse mode.

2. A device as set forth in claim 1, wherein said first and second converting means are equally and symmetrically constructed, said first converting means functioning as an AC-DC converter and said second converting means functioning as a DC-AC inverter during normal operation of the motor in a driving mode, and said second converting means functioning as an AC-DC converter and said first converting means functioning as a DC-AC inverter during a power regenerating mode.

3. A device as set forth in claim 2, wherein said control means controls the operation modes of said first and second converting means in response to the output of said first and second detecting means.

4. A device as set forth in claim 1, wherein the first and third switch means are normally biased closed, and the second and fourth switch means are normally biased open.

5. A device as set forth in claim 3, wherein the first and third switch means are normally biased closed, and the second and fourth switch means are normally biased open.

6. A device as set forth in claim 4, wherein said first and second detecting means comprise current sensors.

7. A device as set forth in claim 5, wherein said first and second detecting means comprise current sensors.

8. In an elevator drive system including an elevator motor (1) driven from an AC power source (8), first means (4) for converting AC power from the source into DC power, said first means also being operable in a reverse mode to convert DC power into AC power, second means (3) for converting DC power from the first converting means into AC power for the motor, an emergency battery (11), means for detecting a failure of the power source, and means for detecting a failure of the second converting means, a method of fault operation comprising the steps of:

(a) energizing the motor from the battery through the second converting means in response to a power source failure detection, and (b) energizing the motor from the battery through the first converting means operating in a reverse mode in response to a second converting means failure detection.

9. A method as defined in claim 8, wherein step (b) comprises:

(1) disconnecting the power source from the first converting means, (2) disconnecting the second converting means from the motor, (3) connecting the battery to a junction between an output of the first converting means and an input of the second converting means, and (4) connecting an input of the first converting means to the motor.

* * * * *